United States Patent [19]

Johne et al.

[11] 4,312,137

[45] Jan. 26, 1982

[54] DRYING DEVICE IN A SHEET-FED ROTARY PRINTING PRESS

[75] Inventors: Hans Johne; Christian Lucas, both of Radebeul; Karl-Heinz Foerster, Dresden; Klaus Schanze, Coswig; Arndt Jentsch, Coswig; Wolfgang Mueller, Coswig; Horst Schulz, Dresden, all of German Democratic Rep.

[73] Assignee: Veb Kombinat Polygraph "Werner Lamberz" Leipzig, Leipzig, German Democratic Rep.

[21] Appl. No.: 115,286

[22] Filed: Jan. 25, 1980

[30] Foreign Application Priority Data

Feb. 1, 1979 [DD] German Democratic Rep. ... 210748

[51] Int. Cl.[3] ..... F26B 15/04

[52] U.S. Cl. ..... 34/43; 34/48; 34/4; 34/41; 101/416 A

[58] Field of Search ..... 34/4, 41, 48, 7, 49, 34/43; 101/416 A

[56] References Cited

U.S. PATENT DOCUMENTS

| | | | |
|---|---|---|---|
| 1,878,318 | 9/1932 | Pinder | 101/416 A |
| 2,656,449 | 10/1953 | Elgar | 34/7 |
| 3,637,983 | 1/1972 | Nelson | 34/49 |
| 3,894,343 | 7/1975 | Pray et al. | 34/49 |
| 4,037,329 | 7/1977 | Wallace | 34/7 |

*Primary Examiner*—Larry I. Schwartz

*Attorney, Agent, or Firm*—Michael J. Striker

[57] ABSTRACT

A printing press includes an impression cylinder formed with axially directed channels for sheet-clamping means, a radiant dryer arranged above the impression cylinder to radiate heat on the printed sheet, a screening hood mechanism tiltably mounted for movement between an inactive position in which the sheet is exposed to heat rays from the dryer and a screening position; the driving motor is connected to the power source by two parallel power supply circuits each including a separate switch, one of the switches being actuated by a relay which in turn is actuated by series-connected contacts closed respectively when the dryer is in operation, when the driving motor is disconnected, when the printing machine stops, and when the channel for the clamping means on the impression cylinder is not facing the dryer.

3 Claims, 5 Drawing Figures

DRYING DEVICE IN A SHEET-FED ROTARY PRINTING PRESS

BACKGROUND OF THE INVENTION

The invention relates to a drying device with a radiant dryer in a sheet-fed rotary printing press.

A sheet-fed rotary printing press with a radiant dryer acting upon the impression cylinder has already been proposed (East German Pat. No. 200 881). This radiant dryer may be enclosed when the press is stopped, by means of a screening hood mechanism, as known, for instance, from German Pat. No. 2 235 047.

It is of disadvantage in this prior art solution that negative influences may be exerted onto the printed sheet held by the clamping device of the impression cylinders, the closed position of the screening hood mechanism notwithstanding. In the most unfavorable instance, burning of the printed sheet or damage to the machine may occur.

SUMMARY OF THE INVENTION

It is the objective of the invention to prevent sheets from becoming unusable by excessive heat and to increase safety in sheet-fed rotary printing presses using radiant dryers.

Another objective of the invention is the creation of a drying device wherein, on stopping the press, no undesired thermal effects will occur in the printed sheet held on the impression cylinder.

According to this invention, the above objectives and others which will become apparent hereafter, are attained by subordinating to a drive motor of the sheet-fed rotary printing press, a channel positioning device effecting conjoint action of the radiant dryer with the clamping channel of the impression cylinder when the press is stopped. The channel positioning device consists of switching elements arranged at the hood mechanism, the switching elements being combined from springloaded roller lever and limit switch and acting in conjunction with the impression surface of the impression cylinder which is interrupted by the clamping channel.

The novel features which are considered as characteristic for the invention are set forth in the appended claims. The invention itself, however, both as to its construction and its method of operation, will be best understood from the following description of specific embodiments when read in connection with the accompanying drawing.

Figure 3:
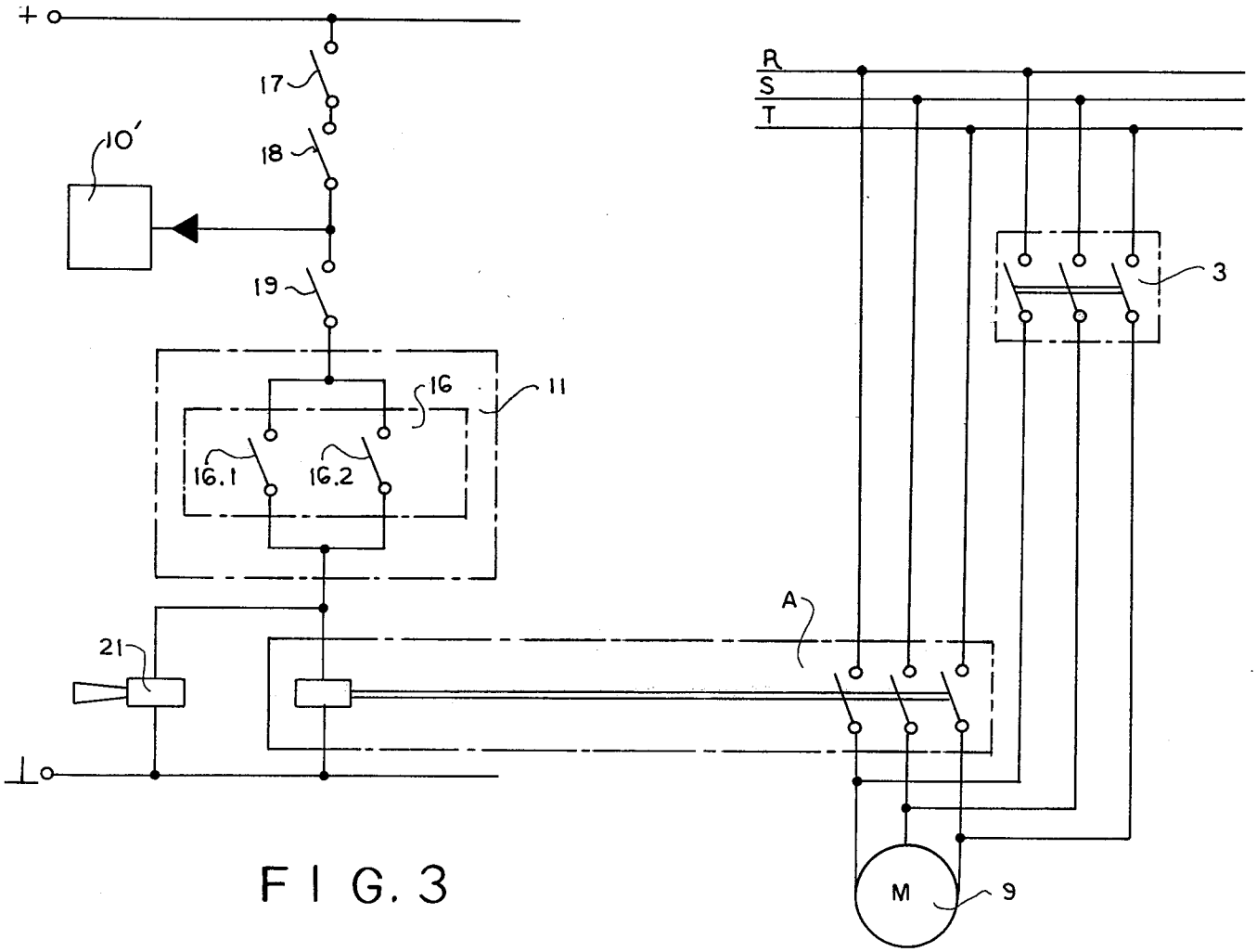

FIG. *2a* is a side view of a dryer screening mechanism shown in its inoperative position during the normal operation of the printing machine;

FIG. *2b* shows the mechanism of FIG. *2a* in a position when the driving motor is switched off;

FIG. *2c* shows the mechanism of FIG. *2a* in a position when the printing machine is stopped; and FIG. 3 is an electrical circuit diagram of the positioning device for the screening mechanism.

DESCRIPTION OF THE PREFERRED EMBODIMENTS

Figure 1:
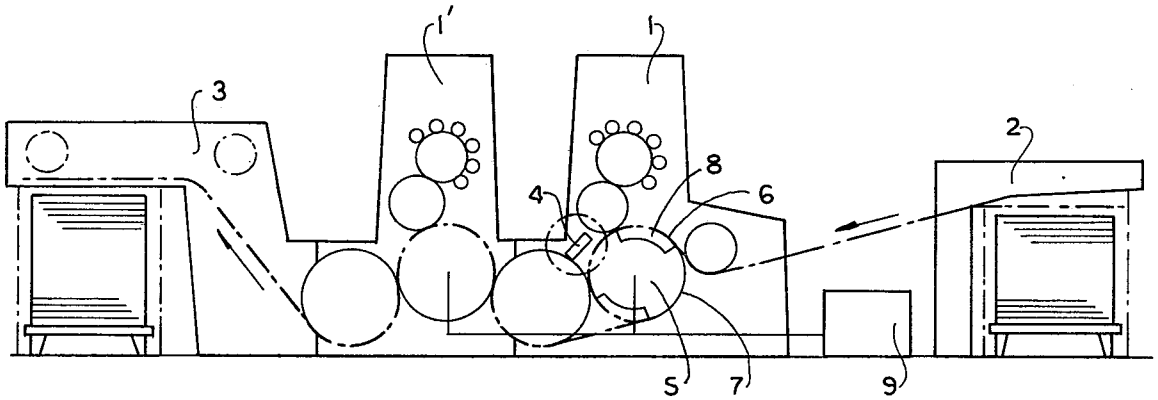
FIG. 1 is a schematic side view of a sheet-fed rotary printing press with drying device.

Referring to FIG. 1, a sheet-fed rotary printing press of conventional design, including two printings units 1 and 1', a sheet feeder 2 and a sheet discharging unit 3, is equipped with a radiant dryer 4. The radiant dryer 4 acts upon a sheet 6 carried by an impression cylinder 5. The impression cylinder 5 has sheet-guiding surfaces 7 and axially directed channels 8 for sheet clamping means.

A driving motor 9 is coupled to the printing units 1 and 1' of the sheet-fed rotary printing press. The radiant dryer 4 is provided with a pivotably supported screening hood mechanism 10. A channel positioning device 11 is arranged laterally at the screening hood mechanism 10.

As indicated schematically in FIGS. *2a–2c*, the channel positioning device is constituted by two two-arm levers 12, pivotally supported on the screening hood mechanism 10. Lower arms of the levers 12 are provided with rollers 13 which normally engage the sheet guide surfaces 7. Compression springs 15 are arranged on the upper arms 14 of respective levers 12 and act against fixed points on the frame of the machine. The upper arms 14 control limit switches 16 mounted on the screening hood mechanism 10.

FIG. 3 shows the circuit diagram of the positioning device 11 for controlling the actuation of the driving motor 9. The motor 9 is connected via a switch B to a power line RST and the switch B controls the normal printing operation of the press. In addition, normally open contacts of a relay A also connect the motor 9 to the power supply line RST when relay A is activated, thus providing a second path of the feeding current for the drive motor 9. The coil of relay A is bridged by an acoustical signalling device 21 and is energized by a direct current power source. The coil of the relay A is connected to the power source by means of the positioning device 11 including the limit switches 16 and by means of series-connected switches 17, 18 and 19. In the circuit diagram, the limit switches 16 are constituted by two parallel-connected switches 16.1 and 16.2.

The operation of the drying device of this invention is as follows:

During the normal operation of the printing press, the switch B is switched on whereas the contacts of relay A are open. The screening hood mechanism 10 is in a non-acting position as shown in FIG. *2a* in which the dryer 4 is switched on by a non-illustrated switch into its operative condition and acts on the sheet 6 carried on the impression cylinder 5. Contact 17 is operated simultaneously with the dryer 4 so that by closing power supply circuit of dryer 4, the contact 17 is also closed whereas during the inactive condition of the dryer the contact 17 is open. Upon switching off the contacts B, the contact 18 is switched on and also contact 17 remains closed because the dryer 4 is in operation. By closing the contact 18, driving means 10' become activated and rotate screening mechanism 10 from its inactive position according to FIG. *2a* into its screening position between the radiant dryer 4 and impression cylinder 5. As soon as the inertial rotary movement of the printing machine fully stops, contact 19 is also closed. In the screening position of the mechanism 10, the rollers 13 either roll on the sheet-guiding surface 7 (FIG. *2b*) or enter the clamping channel 8 (FIG. *2c*). In the first instance, the normally closed limit switches 16 are disengaged from the upper arms 14 of levers 12 and will remain closed, whereas in the second instance, when the rollers 13 enter the channel 8, the compression springs 15 displace the upper arm 14 to activate the limit switches 16 and the contacts 16.1 and 16.2 are opened. As a consequence, the coil of the relay A is deenergized and the contacts of the relay A disconnect the second feeding path for the driving motor 9.

Figure 2A:
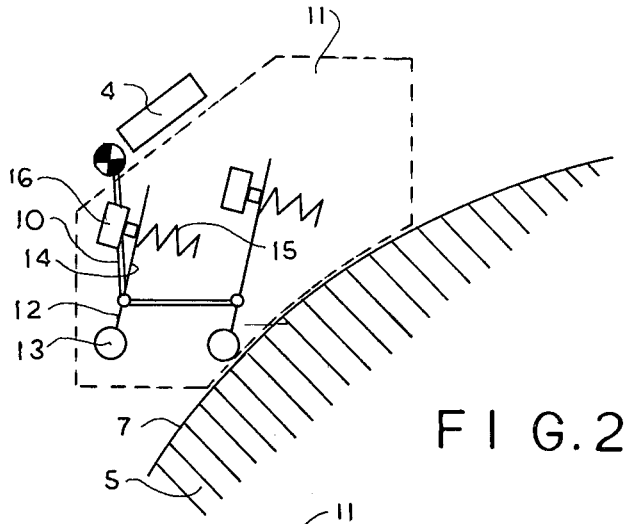
Figure 2B:
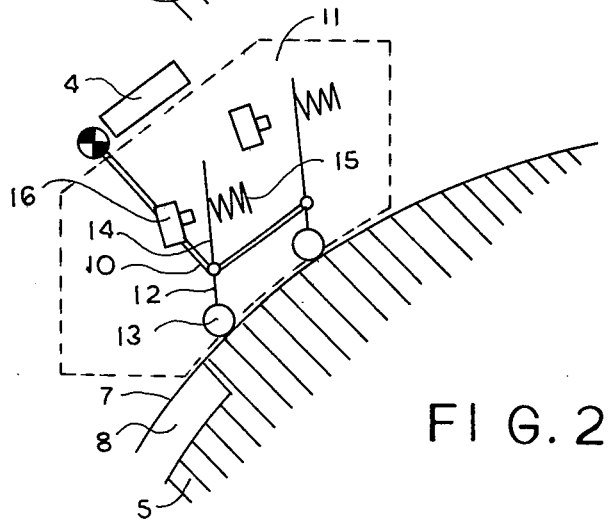
Figure 2C:
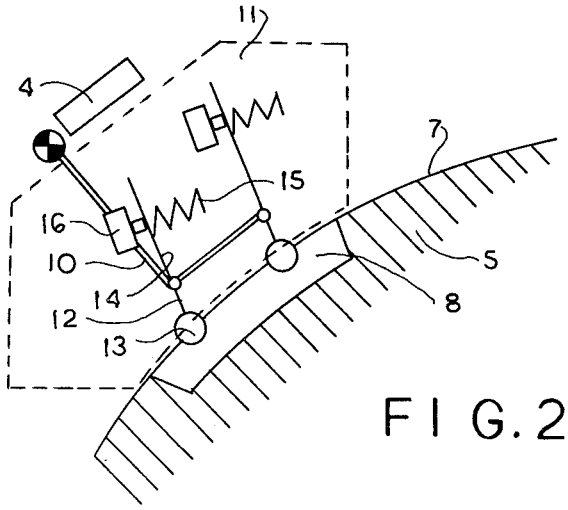

If, however, the screening hood mechanism 10 and the rollers 13 are in the position illustrated in FIG. 2*b*, in which the limit switches 16 are not acted upon by arm 14 and contacts 16.1 and 16.2 remain closed, due to the standstill of the printing press, all contacts 17, 18 and 19 are also closed, the coil of relay A is energized and closes the second current feeding path for the motor 9, so that the latter starts driving the printing machine so long until the rollers 13 of the screening hood mechanism 10 enter the clamping channel 8 as illustrated in FIG. 2*c*. In this position end switches 16 are acted upon by the 14 and their contacts 16.1 and 16.2 are opened. As a result, relay A is denergized and disconnects also the driving motor 9. In the position of FIG. 2*b*, in which all contacts 17, 18, 19, 16.1 and 16.2 are closed, the acoustical alarm 21 is activated and generates a warning signal until the clamping channel 8s is positioned opposite to the radiant dryer 4. As soon as the rollers 13 enter the clamping channel 8, the alarm device 21 is also deenergized to indicate that the radiant dryer 4, upon the final stop of the machine, does no longer act upon the sheet 6 but upon the clamping channel 8.

It will be understood that each of the elements described above, or two or more together, may also find a useful application in other types of constructions differing from the types described above.

What is claimed as new and desired to be protected by Letters Patent is set forth in the appended claims:

1. In a sheet-fed rotary printing press having an impression cylinder provided with an axially directed channel for accommodating sheet clamping means, a combination comprising a drying device arranged above said impression cylinder to transmit heat rays against the printed sheets on the impression cylinder; an electrical motor for driving the printing press; two parallel-connected power supply circuits for said electrical motor, each power supply circuit including a separate switch; screening means arranged in said printing press for moving between an inactive position in which it exposes the sheet on said impression cylinder to said dryer when the press is running and a screening position between said dryer and said impression cylinder when the press comes to full stop; and control means coupled to one of said switches to control the driving motor in response to the position of said channel relative to said dryer, said control means activating said motor when the other switch is opened, the drying device is in operation, the printing press comes to full stop and the impression cylinder is in an angular position in which the channel is remote from the dryer, and thereafter deactivating said motor when the channel faces said dryer.

2. A combination as defined in claim 1, wherein said control means includes a relay for closing said one switch; a power source for said relay, a plurality of series-connected switches for connecting said relay to said power source, and means for closing one of said series-connected switches when the dryer is in operation, for closing another of said series-connected switches when the other motor switch is disconnected, for closing a third of said series-connected switches when said printing press stops, and for closing the fourth of said series-connected switches when said channel is remote from said dryer.

3. A combination as defined in claim 2, wherein said fourth series-connected switch includes at least one normally closed limit switch mounted on said screening means, a two-arm roller pivotally mounted on said screening means to engage with its roller said impression cylinder when said screening device is rotated into its screening position, and a compression spring cooperating with the other arm of said lever to actuate said limit switch when said roller enters said channel, thus opening the fourth of said series-connected switches.

* * * * *